US006059402A

United States Patent [19]

Martens

[11] Patent Number: 6,059,402

[45] Date of Patent: May 9, 2000

[54] CONFIGURATION FOR INK SUPPLY AND INK DISPOSAL FOR AN INK PRINTING HEAD

[75] Inventor: Rolf Martens, Hamburg, Germany

[73] Assignee: Francotyp-Postalia A.G. & Co., Birkenwerder, Germany

[21] Appl. No.: 08/838,434

[22] Filed: Apr. 7, 1997

[30] Foreign Application Priority Data

Apr. 6, 1996 [DE] Germany ..... 196 13 944

[51] Int. Cl.[7] ..... B41J 2/175

[52] U.S. Cl. ..... 347/86

[58] Field of Search ..... 347/85, 86, 87, 347/36

[56] References Cited

U.S. PATENT DOCUMENTS

| | | | |
|---|---|---|---|
| 4,196,625 | 4/1980 | Kern | 73/304 |
| 4,695,824 | 9/1987 | Tazaki | 347/86 |
| 4,782,754 | 11/1988 | Pohlig | 101/364 |
| 4,853,708 | 8/1989 | Walters | 347/86 |
| 5,283,593 | 2/1994 | Wehl . | |
| 5,477,963 | 12/1995 | Mochizuki | 206/701 |

FOREIGN PATENT DOCUMENTS

| | | |
|---|---|---|
| 0 364 284 A2 | 4/1990 | European Pat. Off. . |
| 0 412 459 A3 | 2/1991 | European Pat. Off. . |
| 0 509 747 A1 | 10/1992 | European Pat. Off. . |
| 90/00976 | 2/1990 | WIPO . |

OTHER PUBLICATIONS

Japanese Patent Abstract No. 58–194552 (Terasawa), dated Nov. 12, 1983.

Japanese Patent Abstract No. 3–7350 (Kitahara), dated Jan. 14, 1991.

Japanese Patent Abstract No. 4–338553 (Shimada), dated Nov. 25, 1992.

Japanese Patent Abstract 03007350 (Niimura H.) dated Jan. 14, 1991.

Japanese Patent Abstract 04338553 (Shimada T.) dated Nov. 25, 1992.

Japanese Patent Abstract 58194552 (Terasawa H.), dated Dec. 11, 1983.

Published European Patent Application 0 364 284 A2 (Kitahara, K.) dated Apr. 18, 1990.

Published European Patent Application 0 412 459 A2 (Ujita, T. et al.) dated Feb. 13, 1991.

Published European Patent Application 0 509 747 A1 (Morandotti, R.) dated Oct. 21, 1992.

*Primary Examiner*—N. Le
*Assistant Examiner*—Michael Nghiem
*Attorney, Agent, or Firm*—Herbert L. Lerner; Laurence A. Greenberg; Werner H. Stemer

[57] ABSTRACT

A configuration for ink supply and ink disposal through connecting lines for an ink printing head has a minimum number of disposable parts, a reliable system for detecting when ink runs out, an easily adaptable coding system for individual types of ink, prevents incorrect insertion and improves servicing properties and environmental friendliness. The configuration has a cassette with a housing and two identically constructed flat boxlike containers supported in the housing. One container is intended for ink supply and the other container is intended for ink disposal. A flexible film for covering the ink is secured in the middle of each container and its size is dimensioned in such a way that the entire container volume can be utilized for the ink. A well is molded into the bottom of the container and outside it two electrodes for detecting the ink running out are fitted into the bottom and spaced apart from one another. A rubber-elastic seal for receiving an ink connecting line is inserted into a front wall of the container. Coding bores are incorporated into the front wall of the housing. Some bores are blocked while the others are open and correspond with associated coding pins in a receptacle for the cassette in the printer.

7 Claims, 2 Drawing Sheets

CONFIGURATION FOR INK SUPPLY AND INK DISPOSAL FOR AN INK PRINTING HEAD

BACKGROUND OF THE INVENTION

Field of the Invention

The invention relates to a configuration for ink supply and ink disposal for an ink printing head, which is connected to the configuration through connecting lines.

Such ink printing heads are used both in typical office printers and in small high-speed printers. The latter are components of modern machines for printing addresses or for product labeling and will soon also be part of machines for applying postage to mail. The function of the printing heads should be assured in such a way that if at all possible no missing ink dots will occur. That is important not only for the sake of the printed image quality in general but also and in particular for security-relevant printed image data, such as the monetary value, the date and the serial number of the machine in the case of postage printing.

If missing ink dots are to be prevented, the ink supply must be reliable and as free of bubbles as possible, and the nozzles of the ink printing head must be kept clean.

In the case of the first of those purposes it is known (see German Patent DE 27 09 730 C2) for the ink connecting line to be docked on the ink container through a hollow needle. The ink container is provided with a rubber-elastic closure that is pierced by the hollow needle. That prevents both the invasion of air into the ink connecting line and an unintended escape of ink from the ink container.

In order to keep the nozzles of the ink printing head clean, ink is expelled cyclically or as needed through all of the nozzles and/or aspirated through the use of a cleaning device, and the nozzle surface of the ink printing head is wiped with a wiping lip, as is seen in German Patent DE 38 10 698 C2 and Published European Patent Application 0 285 155 A1. The ink occurring in the cleaning procedure, which is referred to below as waste ink, must be disposed of in such a way that soiling of the apparatus and its surroundings is avoided.

An ink supply device for a multicolor inkjet plotter is known (see German Patent DE 33 16 969 C2), in which on one hand the ink tank for the most frequently used kind of ink and an element that retains the ink, as waste in a receptacle, are combined in a first interchangeable unit, and on the other hand the remaining types of ink are in turn combined into a further interchangeable unit. The ink-retaining element is typically necessarily changed as well when the emptied ink tank for the most frequently used ink is replaced. The first unit is constructed essentially as a flat housing, which is subdivided into an upper chamber for receiving and retaining an ink tank of elastic material, and a lower chamber having an adsorbing substance for receiving and storing the waste tank. A pump carries the waste ink through a tube to the adsorber. The ink tank communicates with the ink printing head through a tube and through a needle. The needle serves as an outlet and is inserted into a rubber connecting piece into which an ink delivery portion of the ink tank discharges on the other end.

When the empty ink tank and the ink-saturated adsorber are removed, suitable precautions must be taken to prevent soiling.

An ink supply container for ink printing devices is also known (see German Patent DE 41 04 786 C2) that is constructed as a disposable container. The ink printing device itself operates by the negative pressure principle, in which the ink supply system has a slight negative pressure with regard to the actual writing nozzle.

In a support housing, a plurality of bags of ink are disposed one above the other. Closure devices that contain a connection piece which can lock in detent fashion in an adapted opening of the support housing are welded to the front of the bags of ink. Once again, the connection piece is closed through a seal of soft rubber or silicon. Once the filled bags of ink have been put in place, the support housing is closed by ultrasound or adhesive bonding in such a way that it is no longer possible to replace the bags of ink. When the ink runs out, accordingly the entire support housing including what it is equipped with is handled as a disposable part. The support housing can be locked in detent fashion into the printer housing. In order to prevent misconnections, guides in the form of coding blocks are mounted on the support housing and cooperate with corresponding counterparts in the detent receptacle. As a result, the connection pieces of the ink supply containers are always associated with the nozzles that expel the proper colors.

Finally, a device for monitoring the supply of electrically conducting writing fluid for ink writing devices is known (see German Patent DE 27 28 283 C3), in which the junction resistance between electrodes is measured, to enable one to detect when the ink runs out. Two depressions separated by a land are molded onto the bottom of a bottle of ink. Two electrodes that detect the liquid-specific comparison resistance are disposed in the one depression and one further electrode is disposed in the other depression.

In a supplement to the above embodiment, an ink container is also known (see Published International Patent Application WO 90/00976), in which a flexible film is secured all the way around in a liquid-tight and gas-tight manner, its size being such that it forms an adequate hollow chamber for the ink liquid and when the container is empty rests on the bottom thereof. A depression is also formed into the bottom of the known container in the region of an ink outlet opening. Two electrodes are also fitted into the bottom, spaced apart from one another.

SUMMARY OF THE INVENTION

It is accordingly an object of the invention to provide a configuration for ink supply and ink disposal for an ink printing head, which overcomes the hereinafore-mentioned disadvantages of the heretofore-known devices of this general type and which has improved servicing properties and environmental friendliness. It is additionally an object of the invention to provide a configuration for ink supply and ink disposal for an ink printing head that is constructed as a structural unit yet makes do with a minimum of disposable parts. The configuration should have a coding system that is easily adaptable to whichever ink is used, which prevents incorrect insertion, and should be equipped with a reliable system for detecting when ink runs out.

With the foregoing and other objects in view there is provided, in accordance with the invention, a configuration for ink supply and ink disposal for an ink printing head, comprising a cassette housing to be inserted into a printer, the housing having a front wall, the front wall having coding openings and access openings formed therein; blocking inserts closing a given number of the coding openings and leaving at least one of the coding openings open; at least one coding pin of the printer for mechanical docking with the at least one open coding opening, for coding corresponding to ink to be used; two identically constructed, flat, boxlike containers supported in the housing, the containers each having a top and a bottom, one of the containers intended for ink supply and the other of the containers intended for ink disposal; seals for the containers accessible through the access openings; flexible films each liquid-tightly and gas-tightly secured in a respective one of the containers, preferably extending all the way around in the middle, the films having a size dimensioned such that each rest on the top of a respective one of the containers when the container is entirely full and rest on the bottom of a respective one of the containers when the container is empty; wells each molded into the bottom of a respective one of the containers; and two mutually spaced-apart electrodes fitted into the bottom of one of the containers, two other mutually spaced-apart electrodes fitted into the bottom of the other of the containers, the electrodes disposed outside the wells.

In accordance with another feature of the invention, the housing has a middle wall, and the containers are disposed side by side or one above the other and separated by the middle wall.

In accordance with a further feature of the invention, the bottoms are each inclined toward a respective one of the wells.

In accordance with an added feature of the invention, there are provided beads each surrounding and protruding past a respective one of the electrodes.

In accordance with a concomitant feature of the invention, the seals are rubber-elastic seals for ink connecting lines, and the containers each have a front wall with a bore formed therein for receiving a respective one of the rubber-elastic seals.

Since the container for the ink supply, which is referred to below as a fresh ink container, and the container for ink disposal, which is referred to below as a waste ink container, are constructed identically, a technological advantage is obtained of not only substantially increasing the repetition rate. In order to provide the initial insertion of the cassette, one filled fresh ink container and one empty waste ink container are needed. In order to provide ensuing insertions, only new fresh ink containers are needed, since the emptied fresh ink containers can be used as waste ink containers. This cuts the number of containers that would otherwise have to be disposed of in half. Since the waste ink container is replaced simultaneously with the fresh ink container, overfilling of the waste ink container is precluded. The flat, elongated structure of the container assures that the slight differences in level at a different fill level only insignificantly affect the hydrostatic pressure of the ink, and that it is predominantly the atmospheric ambient pressure that acts on the ink.

The preferably central securing of a suitably oversized flexible film makes it possible to utilize the full container volume for the fresh ink meant to fill it.

The forming of a depression of small volume and the placement of the electrodes outside it in the bottom assure an adequately great change in resistance for detecting when the ink runs out. These provisions are further reinforced by the inclination of the bottom toward the depression.

The manner in which encoding is done, by blocking off certain coding openings, for instance three out of five or six out of eight of them, thus makes such great versatility of coding possible that any arbitrary type of ink can be detected.

The mechanical docking of the cassette with the associated receptacle in the printer, through the use of the combination of two coding bores and two coding pins, is quite simple.

Expediently, the same number of bores for inserting coding pins are provided in the receptacle as there are coding bores in the front wall of the cassette housing. Retrofitting to make country-specific adaptations is easily possible by suitable insertion of the coding pins.

Due to the configuration according to the invention, both the cassette as a whole and the containers individually can be replaced easily and without the danger of soiling.

Other features which are considered as characteristic for the invention are set forth in the appended claims.

Although the invention is illustrated and described herein as embodied in a configuration for ink supply and ink disposal for an ink printing head, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
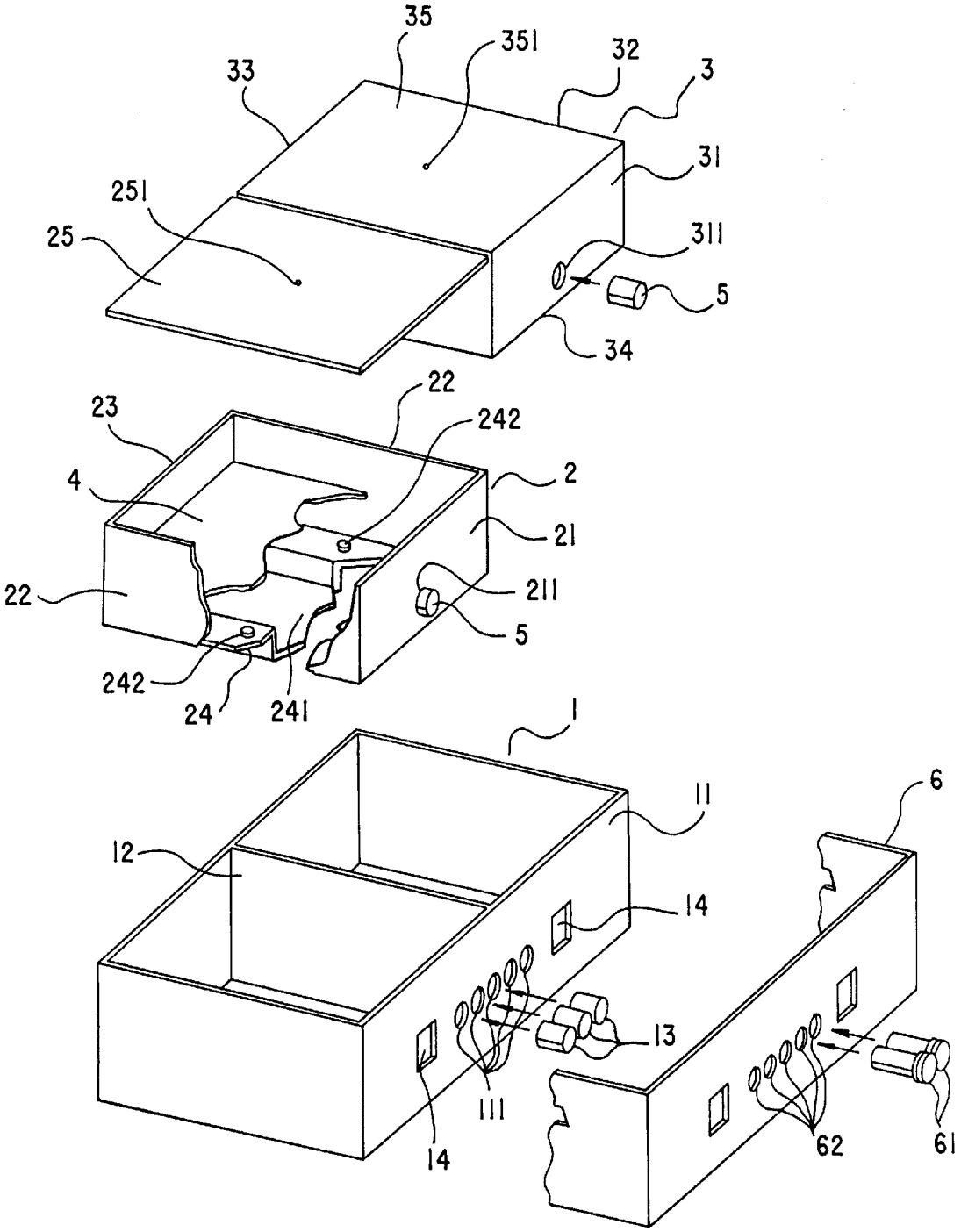
FIG. 1 is a fragmentary, diagrammatic, partly broken-away, exploded perspective view of a cassette.
Figure 2:
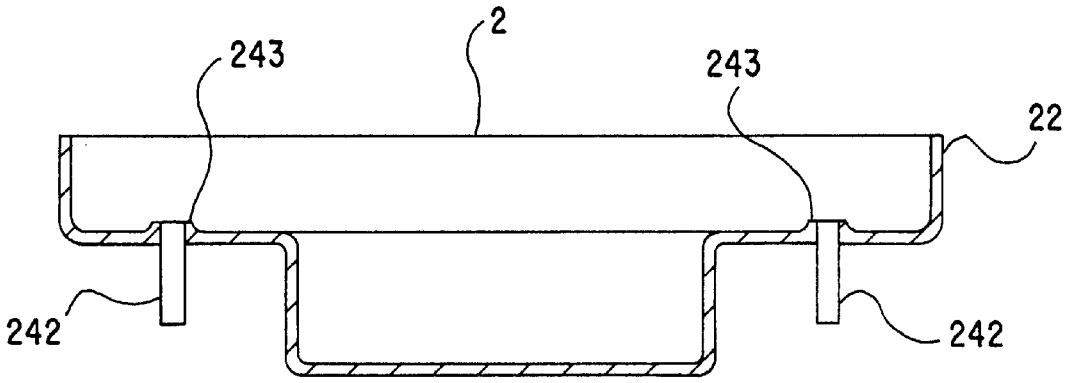
FIGS. 2 and 3 are cross sectional views of containers for an ink supply.
Figure 3:
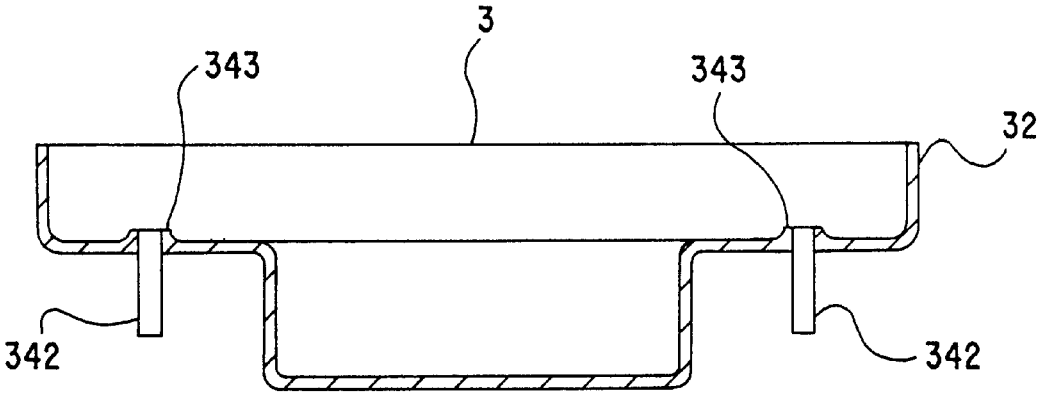

Referring now to the figures of the drawings and first, particularly, to FIG. 1 thereof there is seen an interchangeable cassette which includes a housing 1 with two compartments that are separated by a middle wall 12 and are intended for receiving two flat, boxlike containers 2, 3. The two containers 2, 3 are constructed identically. The container 2 is intended for ink supply. The container 3 is provided for ink disposal. Each container 2, 3 has a front wall 21, 31, two side walls 22, 32, one back wall 23, 33, one bottom 24, 34 and one top 25, 35 with a vent hole 251, 351. A depression or well or hollow 241 for receiving a remaining amount of ink is molded into the bottom 24. A non-illustrated depression or well is molded into the bottom 34. Outside the well 241, two electrodes 242 are fitted into and pass through the bottom 24 and can be electrically contacted with a non-illustrated evaluation circuit located in a printer. The same configuration of electrodes is provided at the bottom 34. Beads 243, 343 surround and protrude past the electrodes 242, 243 (FIGS. 2 and 3). As long as there is an ink liquid column present between the electrodes 242, the resistance is substantially less than if ink were present only in the well 241. In order to allow the ink to flow readily into the wells, the bottoms 24, 34 are inclined toward the wells.

A flexible film 4 is attached to the middle of the vertical walls all the way around in a liquid-tight and gas-tight fashion. The film 4 is constructed in a known manner from polyethylene film in the form of a laminate with at least two layers, in such a way that it is gas-tight. The dimensions of the film 4 are selected in such a way that the fill volume of the container 2 can be utilized as completely as possible. In order to fill the container with fresh ink, the container 2 is placed with its bottom 24 facing upward and is filled up to approximately a stop through a non-illustrated hole in the well 241. The hole is then welded or firmly sealed in some other way.

Rubber-elastic seals 5 are fitted into bores 211, 311 in the front walls 21, 31 of the containers 2, 3. As already explained earlier in the description, this seal 5 is pierced in a known manner by a hollow needle which is part of an ink connecting line. This ink connecting line leads from the container 2, which is the fresh ink container, to an ink printing head in the printer. An ink connecting line leads from the container 3, which is the waste ink container, to a cleaning station. The cleaning station receives the ink expelled in the cleaning of the ink printing head and removed by suction and pumps the waste ink into the container 3.

Five coding bores 111 are located in a front wall 11 of the housing 1. Three of the coding bores 111 are closed through the use of locking inserts 13. Associated bores 62 for receiving coding pins 61 are located in a receptacle 6 intended for the cassette in the printer. In this case, the coding pins 61 are inserted into the bores 62 that are opposite the free coding bores 111. In the manner described above, the cassette can be inserted only if the coding between the cassette and the receptacle in the printer match. Once the cassette is inserted into the receptacle 6, the mechanical coupling is effected through the use of the pairing of the coding bores 111 and the coding pins 61. The fluid coupling is effected through the use of hollow needles and the electrical coupling is effected through the use of the electrodes 242 and associated contacts. Access openings 14 are provided in the front wall 11 for the seals 5.

I claim:

1. A configuration for ink supply and ink disposal for an ink printing head, comprising:

a cassette housing to be inserted into a printer, said housing having a front wall, said front wall having coding openings and access openings formed therein;

blocking inserts insertable in said coding openings for closing a given number of said coding openings and leaving at least one of said coding openings open;

at least one coding pin of the printer for mechanical docking with said at least one of said coding openings, for coding corresponding to ink to be used;

two identically constructed, flat, boxlike containers supported in said housing, said containers being insertable into and removable from said cassette housing, one of said containers intended for ink supply and the other of said containers intended for ink disposal, each of said containers having a top wall and a bottom wall, a seal accessible through one of said access openings, a flexible film liquid-tightly and gas-tightly secured in each of said containers, said film touching said top wall when said containers are entirely full and touching said bottom wall when said containers are empty, a well molded into said bottom wall, and two mutually spaced-apart electrodes fitted into said bottom wall, said electrodes disposed outside said well.

2. The configuration according to claim 1, wherein each of said containers has four vertical walls, said flexible film attached to said four vertical walls between said top wall and said bottom wall.

3. The configuration according to claim 1, wherein said housing has a middle wall, and said containers are disposed side by side and separated by said middle wall.

4. The configuration according to claim 1, wherein said housing has a middle wall, and said containers are disposed on top of each other and separated by said middle wall.

5. The configuration according to claim 1, wherein said bottom is inclined toward said well.

6. The configuration according to claim 1, including beads each surrounding and protruding past a respective one of said electrodes.

7. The configuration according to claim 1, wherein said seal is a rubber-elastic seal for an ink connecting line, and each of said containers has a front wall with a bore formed therein for receiving said rubber-elastic seal.

* * * * *